US005983955A

United States Patent [19]

Hellstroem

[11] Patent Number: 5,983,955

[45] Date of Patent: Nov. 16, 1999

[54] YARN FEEDING DEVICE HAVING STORAGE DRUM WITH LIGHT GUIDE

[75] Inventor: Jerker Hellstroem, Nol, Sweden

[73] Assignee: Iro Ab, Ulricehamn, Sweden

[21] Appl. No.: 08/913,577

[22] PCT Filed: Mar. 8, 1996

[86] PCT No.: PCT/EP96/01006

§ 371 Date: Sep. 15, 1997

§ 102(e) Date: Sep. 15, 1997

[87] PCT Pub. No.: WO96/28594

PCT Pub. Date: Sep. 19, 1996

[30] Foreign Application Priority Data

Mar. 10, 1995 [DE] Germany ..... 195 08 758

[51] Int. Cl.[6] ..... D03D 47/34; B65H 51/22

[52] U.S. Cl. ..... 139/452; 242/364.8; 356/429

[58] Field of Search ..... 139/452; 242/364.8, 242/365.4; 356/429

[56] References Cited

U.S. PATENT DOCUMENTS

| | | | |
|---|---|---|---|
| 4,407,336 | 10/1983 | Steiner . | |
| 4,653,701 | 3/1987 | Riva . | |
| 4,687,149 | 8/1987 | Riva . | |
| 4,715,411 | 12/1987 | Van Bogaert et al. | 139/452 |
| 4,936,356 | 6/1990 | Ghiardo . | |
| 5,119,998 | 6/1992 | Tholander et al. . | |
| 5,221,960 | 6/1993 | Akerlind et al. | 356/429 |
| 5,377,922 | 1/1995 | Fredrilsson et al. | 139/452 |
| 5,613,528 | 3/1997 | Zenoni et al. | 139/452 |

FOREIGN PATENT DOCUMENTS

| | | |
|---|---|---|
| 0 192 821 A1 | 9/1986 | European Pat. Off. . |
| 0 192 851 A2 | 9/1986 | European Pat. Off. . |
| 0 327 973 A1 | 8/1989 | European Pat. Off. . |
| 31 23 760 A1 | 2/1982 | Germany . |
| WO 89/08600 | 9/1989 | WIPO . |

*Primary Examiner*—Andy Falik

*Attorney, Agent, or Firm*—Flynn, Thiel, Boutell & Tanis, P.C.

[57] ABSTRACT

A feeding device for a yarn includes a storage drum to which yarn is fed tangentially by means of a winding drive. The yarn is stored in windings on the storage drum in a yarn reserve and can be withdrawn therefrom overhead. The feeding device also includes at least one optoelectronic yarn sensing device which is arranged in a stationary manner outside the storage drum and includes a light source arrangement, a signal-generating receiver arrangement and a light guide. The light source arrangement includes a light outlet which is oriented towards the storage drum, and the receiver arrangement is oriented towards a sensing region on the storage drum. The light guide includes an inlet which is directed outwardly towards the light outlet, and an outlet which is directed outwardly towards the receiver arrangement wherein the inlet and the outlet of the light guide are arranged in positions on the storage drum which are at least axially-spaced apart.

21 Claims, 3 Drawing Sheets

YARN FEEDING DEVICE HAVING STORAGE DRUM WITH LIGHT GUIDE

FIELD OF THE INVENTION

The present invention relates to a feeding device having an optoelectronic yarn sensing device for sensing yarn windings on a storage drum.

BACKGROUND OF THE RELATED ART

In feeding devices which are known from EP-B1-0 192 821 and EP-B1-0 192 851, the optoelectronic yarn sensing device determines the number of windings in the reserve or the position of the reserve limit at the withdrawal side to control the winding drive which winds yarn onto the storage drum which is designed as a rod cage (with stationary rods and advance rods) (reserve sensor or reference sensor). The light source arrangement, the receiver arrangement and the light guide which extends in a U-shaped bow are positioned in the same plane, which is vertical to the longitudinal axis of the storage drum, so that there is a spacing between inlet and outlet in the circumferential direction. A plurality of light source arrangements and receiver arrangements are lined up in the axial direction of the storage drum, and a plurality of light guides extending in the circumferential direction are arranged side by side in parallel in the storage drum. The circumferential distance prevents light which has been reflected by the light source arrangement in a scattered manner from passing to the receiver arrangement. Each light guide ensures that only light that has entered into the inlet is radiated from the outlet to the receiver arrangement. Inlet and outlet of each light guide are positioned in two separate advance rods of the storage drum. In the operative state of the winding drive, the advance rods carry out oscillating movements in relation to the light sources and receiver arrangements. The inlet and outlets at the advance members follow the oscillating movements. Moreover, the storage drum unavoidably oscillates about the axis of the storage drum during operation of the winding drive. The inlet and outlet of the same light guide are simultaneously covered by a yarn winding. The light source arrangement must be positioned in the same circumferential plane as the receiver arrangement. This makes a precise and reasonable evaluation of the signal difficult during the oscillatory and vibratory movement of the inlet and outlet. Moreover, the sensing device occupies a lot of space in the circumferential direction of the storage drum in an inappropriate manner.

It is the object of the present invention to provide a feeding device of the above-mentioned type in which significant signals that can easily be evaluated can be generated on the basis of the yarn sensing operation, with the advantage of light guides being maintained, and in which yarn can generally be sensed individually with movements that differ from one another.

SUMMARY OF THE INVENTION

This object is achieved according to the invention with a feeding device having an optoelectronic sensor with a light guide wherein an inlet and an outlet of the light guide are axially spaced apart.

In this configuration, there is only one end, e.g. the outlet or the inlet, of the light guide in the circumferential direction of the storage drum in which the yarn is to be sensed. By contrast, the other end is axially spaced from the outlet. A yarn which moves over the one end has no longer any objectionable influence on the optical cooperation between the other end, e.g. the outlet, and the receiver arrangement or the light source. In other words, the inlet is, for instance, positioned on the surface of the storage drum where the yarn moves in time-shifted fashion and/or at another speed and/or in another geometrical array than it does over the outlet of the light guide. As a result of such an arrangement, there is a simple signal evaluation which, surprisingly enough, can hardly be impaired by oscillations or vibrations. Very little space is occupied by the sensing device in the circumferential direction of the storage drum. Thanks to such an arrangement, it is not only the size of the reserve or the movement of the withdrawal direction at the front reserve limit that can be reliably sensed, but alternatively, or additively, also other yarn movements, such as the proper winding of the yarn at the end of the reserve at the feed side or the rotating withdrawal movement of the yarn.

In one embodiment the position of the inlet must be chosen such that no malfunction that would impair the useful signal arises from the very rapid movement of the yarn over the inlet.

In a further embodiment a displacement in the circumferential direction of the storage drum is provided for in addition to the axial displacement between the inlet and the outlet.

In a further embodiment, the position and/or movement of the reserve limit is sensed, for instance, in order to control the winding drive in such a manner that a specific size of the reserve is observed. In another embodiment, the first yarn winding(s) are sensed in the reserve at the winding-up side to detect yarn breakage in the supply path leading to the reserve. When the end of the light guide is exposed, the winding drive will be switched off, a fault signal will be set and, optionally, the textile machine fed by the feeding device will be stopped.

In a particularly important embodiment, an end of the light guide is formed such that it is line-shaped and spread to a substantially greater degree than the other, axially spaced-apart end of the same light guide, and the one line-shaped end is substantially oriented in the circumferential direction of the storage drum and is arranged at a place where it is swept over by yarn windings extending in the circumferential direction. This end may be the inlet or the outlet of the light guide. Such an arrangement leads to an extremely strong modulation because the yarn moving in a direction transverse to its longitudinal direction over the spread end will cover this end very rapidly and again expose it very rapidly. A very strong modulation is obtained in this way. By contrast, when the yarn moves over the other, axially spaced round or square end, this movement is performed at a substantially weaker modulation which can clearly be distinguished from the strong modulation when the line-shaped end is being swept over.

The light guide expediently consists of a plurality of parallel fibers which are arranged side by side in the line-shaped end of the light guide in the circumferential direction of the storage drum, whereas they are bundled at the other end.

Alternatively, the light guide may be a flat film band, e.g. made from plexiglass, whose one end is arranged to be located approximately in the circumferential direction of the storage drum, whereas its other end is diposed approximately in the axial direction of the storage drum, i.e., axially spaced apart from the one end.

In a further alternative, the light guide may be a molded body, e.g. made from plexiglass or the like, which comprises an end in the manner of a flat band as well as a round or square end which are interconnected via a light-transmitting body, with the end which is formed in the manner of a flat band being oriented in the circumferential direction of the storage drum, whilst the round or square end is axially spaced therefrom. Either the flat-band end or the other end are used as an inlet for light.

In an alternative embodiment, the passage of the already axially oriented yarn is sensed during its withdrawal from the reserve, e.g., in order to count the number of windings withdrawn and to arithmetically use the information for controlling the reserve size and/or to operate, in the case of a measurement feed device, the stop device which limits the length of weft, and/or to indicate a malfunction in the absence of passage signals and to switch off the winding drive or a downstream textile machine (weft monitoring device).

In a further embodiment, the sensing device comprises a plurality of sensors which sense movements of the yarn independently of each other at different positions. Despite the sensing of different yarn movements, use is made of a joint light source arrangement which is oriented towards the combined inlets of the light guides. The combined inlets are positioned such that continuous yarn does not produce any significant disturbance for the useful signals at that position. A joint light source arrangement saves space and reduces the energy efforts. It is possible to improve the noise ratio (signal-to-noise ratio) when the signals are evaluated.

Since in a suitable embodiment each inlet and each outlet are arranged in the same stationary rod of the storage drum, this arrangement yields reliable sensing characteristics. The light guide(s) is/are accommodated in the rod in a structurally simple manner. It suffices to introduce, for instance, a light guide, such as a light guide cable or a light guide fiber, into fitting holes of the rod, to secure the ends by way of a snug fit or by gluing and to cut off projecting end portions such that they are flush with the surface of the rod.

The use of a light guide cable or a light guide fiber of glass or plexiglass is especially expedient.

Alternatively, the light guide can also consist of a prism or mirror arrangement.

The cross-sectional areas of the inlet and the outlet can be kept deliberately small, e.g. at about only 1.0 mm, so that distinctive signals or a clear modulation can also be observed in thin yarns. With line-shaped and circumferentially oriented ends of the light guide, the width thereof may also be 1.0 mm or less, while the extension measured in the circumferential direction is 10 mm or clearly more.

To avoid any disorder caused by unavoidable vibrations of the storage drum during operation with respect to signal derivation and signal evaluation, and to permit a very useful differential evaluation, at least the receivers should each be provided and connected in dual fashion.

The effect of scattered or extraneous light on the signal evaluation can be diminished by an acute angle, specifically, of the light exit from the outlet with a radius onto the axis of the storage drum through the outlet.

In an embodiment the sensor housing can be simple with respect to construction and technical assembly, and it can be slender and compact. A short construction length is also achieved for the sensor housing with a plurality of sensors for the same storage drum.

In a further embodiment, the sensing characteristics are also improved under critical ambient or stray light conditions by modulated light. The light can be modulated in a permanent manner. However, it is also possible to modulate the light only during specific operative phases, e.g. in the range of about 200 kHz, Finally, in an embodiment which is of special importance to the withdrawal sensor, the additional function of a weft monitoring device has been assigned to the feeding device, which dispenses with a weft monitoring device which is normally provided downstream of the feeding device. The circumferentially spaced-apart outlets which are fed with light from the joint inlet are able to detect the proper movement of a yarn during its withdrawal and can react rapidly in response to any disturbance so as to switch off the feeding device and the textile machine supplied with yarn by the feeding device, for instance a weaving machine.

BRIEF DESCRIPTION OF THE DRAWINGS

Embodiments of the subject matter of the invention shall now be explained with reference to the drawing, in which.

DETAILED DESCRIPTION

Figure 1:
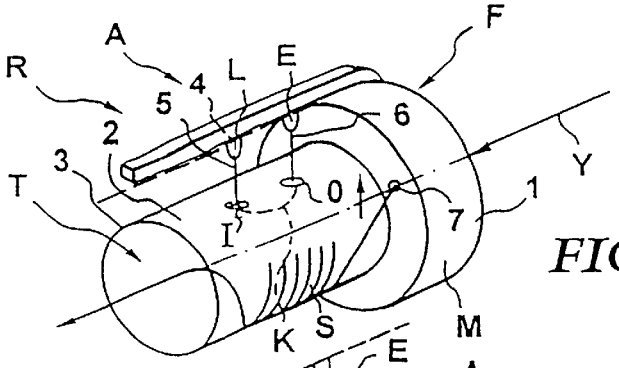
FIG. 1 is a diagrammatic perspective view of a feeding device including an optoelectronic sensing device.

A feeding device F according to FIG. 1, in particular a weft-yarn storing and feeding device for weaving machines, comprises a stationary housing 1 in which a drive motor M for a winding element 7 is accommodated and forms a winding drive with said element. The motor housing 1 has disposed thereon a stationary storage drum T which defines an approximately cylindrical storage surface 2 and includes a withdrawal region 3 at the face side. An extension arm 4 of housing 1 has, inter alia, accommodated therein an optoelectronic sensing device A, namely a so-called reserve sensor R whose main components are a light source arrangement L and a receiver arrangement E in extension arm 4, and a light guide K with an inlet I and an outlet O in the storage drum T. A spacing which is bridged by light guide K is provided between inlet I and outlet O in axial direction. Light guide K may be a light guide cable which is made from glass or plexiglass and has one or several fibers (monoblock or multipart structure), or it may be a light-guiding film. However, it is also possible to use a prism or mirror arrangement as a light guide K. The inlet I and the outlet O, have instance, a diameter of about 1 mm each.

The light source arrangement L, for instance, an LED for constant or modulated light (a plurality of light sources may also be arranged in the light source arrangement in closely adjacent fashion) is oriented with its light exit towards the inlet I, so that emitted light 5 impinges on inlet I. The outlet O, or the light exiting direction of outlet O, is oriented towards the receiver arrangement E, so that light 6 which has been transmitted by means of light guide K will impinge on the receiver arrangement E. The receiver arrangement may be a photodiode or a phototransistor. It is also possible to use a plurality of photodiodes, which are closely arranged side by side in groups, as the receiver arrangement.

The yarn, which is designated by Y, is supplied to the feeding device F in the direction of the arrow, it passes through the winding element 7 and is deposited by means of the winding drive in adjacent windings as a reserve S on the storage surface 2 (not shown in FIG. 1.) Yarn Y is drawn from the reserve overhead the storage drum T and over the withdrawal region 3 in axial direction in response to consumption (in a weaving machine intermittently with the weaving clock rate). The winding drive keeps the reserve on the storage surface 2 within a predetermined size (axial extension or number of windings) in response to consumption. The winding drive is, for instance, controlled with the aid of the reserve sensor R in such a manner that in case of a decreasing reserve it will supplement said reserve, that it will be deactivated when a predetermined size has been reached, or it will be set to a mean speed level in case of relatively regular changes in the reserve.

Outlet O is arranged at an axial position of storage drum T at which the limit for the reserve at the widthrawal side is to be approximately positioned. Inlet I is disposed downstream of reserve S and is arranged closer to the withdrawal region 3 than outlet O. With axially advancing yarn windings, the outlet O is, for instance, covered by the foremost yarn winding, or in case of yarn consumption, it is again exposed in that the foremost winding is withdrawn. The yarn is removed from the reserve obliquely forwardly, with the yarn running around the withdrawal region 3. Upon withdrawal of a yarn winding, the yarn will move past the inlet I at a relatively rapid pace with a motional component extending in the circumferential direction, whereas the axial traveling movement of the reserve limit at the withdrawal side is performed at a relatively slow pace.

Figure 2:
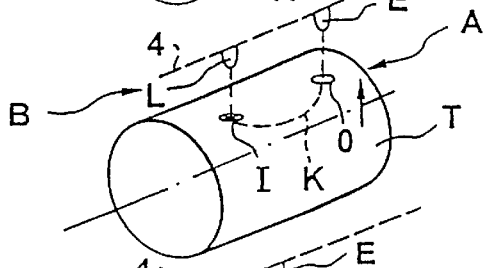
FIG. 2 is a partial view of another embodiment of the invention which defines a yarn brake sensor.

A yarn break sensor B which consists of the light source arrangement L and the receiver arrangement E in extension arm 4 and of the light guide K with inlet I and outlet O on the surface of the storage drum T is provided in the embodiment of FIG. 2 (in extension arm 4). The inlet I is substantially in the same position as in FIG. 1. By contrast, in the yarn break sensor, the outlet O is located so close to the winding element 7 that it can be covered by the first yarn winding(s) provided at the feed side in the reserve.

Figure 3:
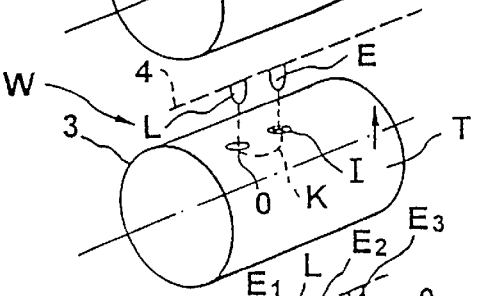
FIG. 3 is a partial view of another embodiment of the invention which defines a withdrawal sensor.

In FIG. 3, the storage drum T has assigned thereto a withdrawal sensor W which consists of the light source arrangement L and the receiver arrangement E in extension arm 4 and of the light guide K with inlet I and outlet O in the storage drum T. Inlet I is substantially located at the same position as in FIG. 1. By contrast, outlet O is arranged closer to the withdrawal region 3 in the axial direction. The yarn which is withdrawn from the reserve passes through the inlet I and through the outlet O, each time at a fast speed with a circumferentially extending motional component.

Figure 4:
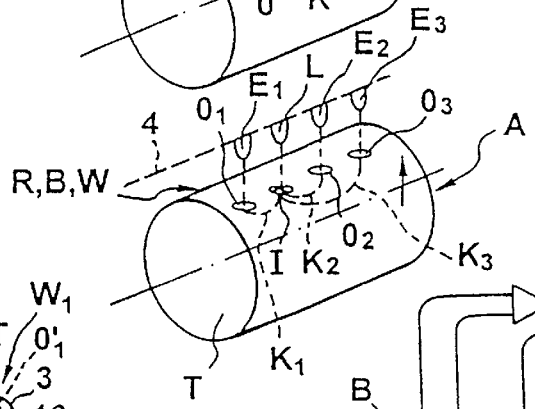
FIG. 4 is a partial view of still another embodiment of the invention having multiple sensors.

As outlined in FIG. 4, the storage drum T has assigned thereto more than one sensor, namely the reserve or reference sensor R, the yarn break sensor B and the withdrawal sensor W. It would also be possible to provide only two of said sensors. This sensing device comprises a light source arrangement L, which is shared by all sensors, as well as three receiver arrangements E1, E2, and E3. The light source arrangement L and the receiver arrangements are expediently lined up in axial direction. A first light guide K1 extends from the joint inlet 1, which is substantially arranged at the same position as in FIG. 1, to the outlet 01 which is oriented towards the receiver arrangement E1 (withdrawal sensor W); furthermore, a second light guide K2 extends to outlet 02 which is oriented towards the receiver arrangement E2 (reserve sensor R), and finally a third light guide K3 extends to outlet 03 which is oriented towards the receiver arrangement E3 (yarn break sensor). Outlets 01,02,03 are approximately located at the positions of the outlets of FIGS. 1, 2 and 3.

Figure 5:
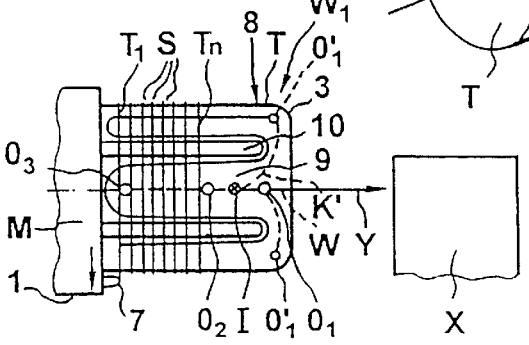
FIG. 5 is a top view showing a further embodiment, similar to the one of FIG. 4.

FIG. 5 shows how the outlets 01, 02, and 03 of light guide K are arranged approximately in axial direction and in spaced-apart relationship with one another. The joint inlet I is also located in this main direction. The storage drum T is designed as a rod-type drum 8 and comprises stationary, circumferentially spaced-apart axial rods 9 as well as axial rods 10 disposed between said rods 9. Rods 10 can optionally be moved by an advance drive (not shown) for separating the yarn windings and for advancing the same on storage drum T to the withdrawal region 3.

Yarn Y is deposited by the winding element 7 in successive windings T1–Tn in the reserve S on the storage drum T. The first winding T1 is deposited in the area where outlet 03 is positioned. Winding Tn which is the foremost one in the direction of withdrawal approximately defines the limit for the reserve S and is disposed at the position of outlet O2. The joint inlet I is located downstream of reserve S at an axial distance from outlet O2. Outlet O1, in turn, is positioned downstream of the joint inlet I and is even closer to the withdrawal region 3.

As outlined in FIG. 5, the first winding T1 moves over outlet 03. In case of consumption the foremost winding Tn of the reserve S will expose outlet 02 with an axial movement. The yarn which is withdrawn from reserve S during consumption is diverted from winding Tn gradually in the axial direction until it will pass over and beyond the withdrawal region 3. During its withdrawal, it will move past the joint inlet I and the outlet O1, sweeping over inlet I and outlet 01 with possibly different motional components in the circumferential directions.

An additional function may be assigned to the withdrawal sensor W as a so-called weft monitoring device which must monitor the proper insertion of a weft yarn into the shed of a weaving machine and which will stop the weaving machine and the feeding device in case of disorder. To this end, as shown in FIG. 5, the joint inlet has connected thereto not only the light guide K1 leading to outlet 01, but also further light guides K1' which lead to outlets 01' that are circumferentially offset relative to outlet 01. These outlets 01' have assigned thereto a corresponding number of further receiver arrangements (not shown). When yarn is withdrawn, a plurality of signals will thus be produced for each winding, because the yarn will move past outlets 01 and 01' in successive order. In such a case the withdrawal sensor W1 will not only be connected to the control device of the winding drive, but also, or optionally exclusively, to a switch-off device for the weaving machine X for immediately switching off the weaving machine in case of malfunction. A plurality of outlets can be used in a special geometrical configuration (axially and in circumferentially space-apart relationship) in the case of both the withdrawal sensor W and the weft monitoring device W1 to enhance the reliability of the sensing operation (for instance with the help of a timebased signal evaluation).

FIG. 5 also demonstrates that the outlets 01, 02, 03 and the joint inlet I are arranged in one and the same stationary finger 9 axially in approximately successive order. Slight displacements in the circumferential direction between the inlet and the outlets are possible due to the construction. The outlets 01' are offset with respect to the outlet 01 in the circumferential direction at any rate.

Figure 6:
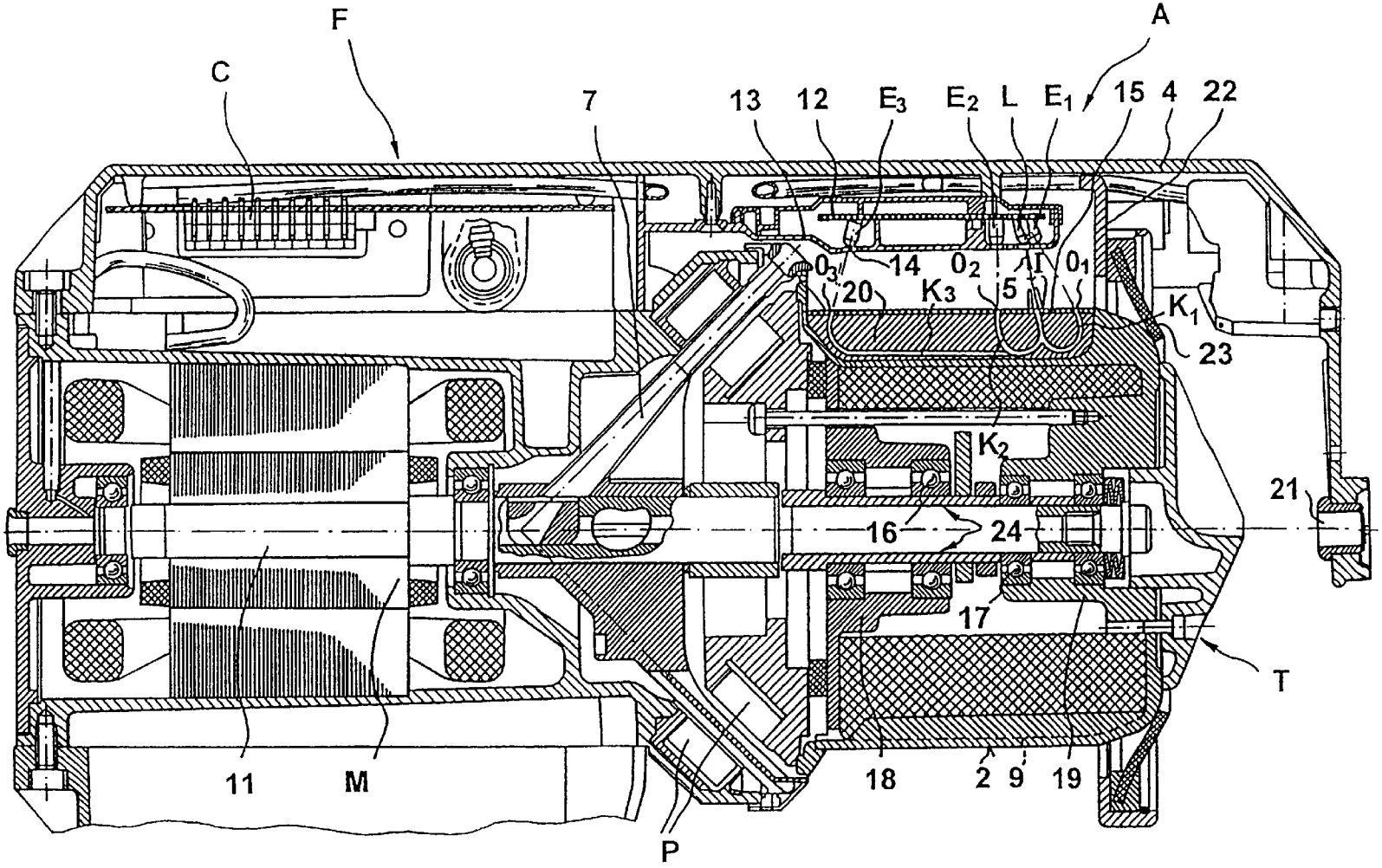
FIG. 6 is a longitudinal section through a feeding device in detail, which largely corresponds to the embodiments shown in FIGS. 4 and 5.

In the feeding device F according to FIG. 6, the electric motor M which is accommodated in housing 1 is controlled via a control device C which processes, inter alia, signals from the sensing device A in the extension arm 4. The motor M drives a hollow main shaft 11 which has mounted thereon the winding element 7 (a hollow tube) in such a manner that it ends next to the storage surface 2 of the storage drum T. The storage drum T is rotatably supported on the main shaft 1 and is prevented by magnets P arranged in the motor housing and in the storage drum from performing a rotational movement. The storage drum T consists of a stationary rod cage 19 which includes fingers 9 and is supported in bearings 17 on the main shaft, and of a rod cage 18 having advance fingers (not shown in FIG. 6) (advance fingers 10 in FIG. 5) which engage between fingers 9. This rod cage 18 is supported with the aid of an inclined and eccentric bushing 24 and with bearings 16 on the main shaft 11 in such a manner that without a rotational movement a wobbling motion is imposed on it by the main shaft 11 (separating and advancing the windings). In one and the same finger 9, the light guides K1, K2 and K3 lead from the joint inlet I to the outlets 01, 02, and 03 at the aforementioned positions, namely in the form of bent loops. In FIG. 6, finger 9 has provided thereon a filling compound 20 in which the light guides are embedded. However, they may also be arranged such that they are exposed. Furthermore, the outlets and the inlet may be covered by a light-transmitting layer 15.

The bottom side of extension arm 4 has provided thereon a slender sensor housing 13 in which the receiver arrangements E1, E2 and E3 and the light source arrangement L are disposed on a common circuit board 12. Lenses or covers 14 are optionally provided in light passage openings. The axial distance between the light source arrangement L and the receiver arrangements E1, E2 and E3 is in each case smaller than the axial distance between the joint inlet I and the outlets 01, 02, and 03. To this end, the light exit directions of outlets 03 and 01 enclose an acute angle in the sectional plane with a respective radius onto the axis of the storage drum T. The receiver arrangements E1 and E3 are given a corresponding inclination. The light exit direction or the light entry direction into the joint inlet also encloses an acute angle with a radius through inlet 1. The light source arrangement L is given a corresponding inclination. When the receiver arrangement E1 in the sectional view according to FIG. 6 partly overlaps with the light source arrangement L, it is positioned in circumferential direction behind the light source arrangement. The light exit direction from outlet 01 is inclined slightly rearwardly from the sectional plane.

Furthermore, a withdrawal eyelet 21 is arranged on extension arm 4 and a yarn brake 23 is held in an axially adjustable manner with a slide 22.

Figure 7:
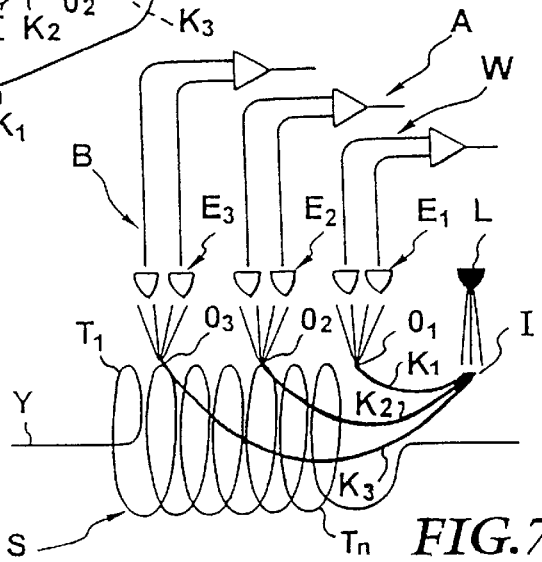
FIG. 7 is a functional diagram; illustrating the optoelectronic sensing device proximate to a yarn reserve.

The functional diagram according to FIG. 7 shows the reserve S which consists of yarn windings T1 to Tn and to which yarn Y is fed from the left side, and from which the yarn is withdrawn to the right side. Light guides K1, K2, K3 connect the joint inlet I to outlets 01, 02, 03 of the sensors, which are here a yarn break sensor B, a reserve or reference sensor R and a withdrawal sensor W. In the receiver arrangements E1, E2, E3, there are provided respective pairs of photodiodes which are connected in pairs at the outlet side through an electronic member. Only one LED is provided in the light source arrangement; however, it would also be possible to combine several LEDs here. A differential reliability-enhancing measurement can thus be performed (by the dual arrangement of the photodiodes). The light source arrangement or the joint inlet could also be diposed at a place of the storage drum T differing from the one as shown, e.g. in the front or face region.

Figure 8:
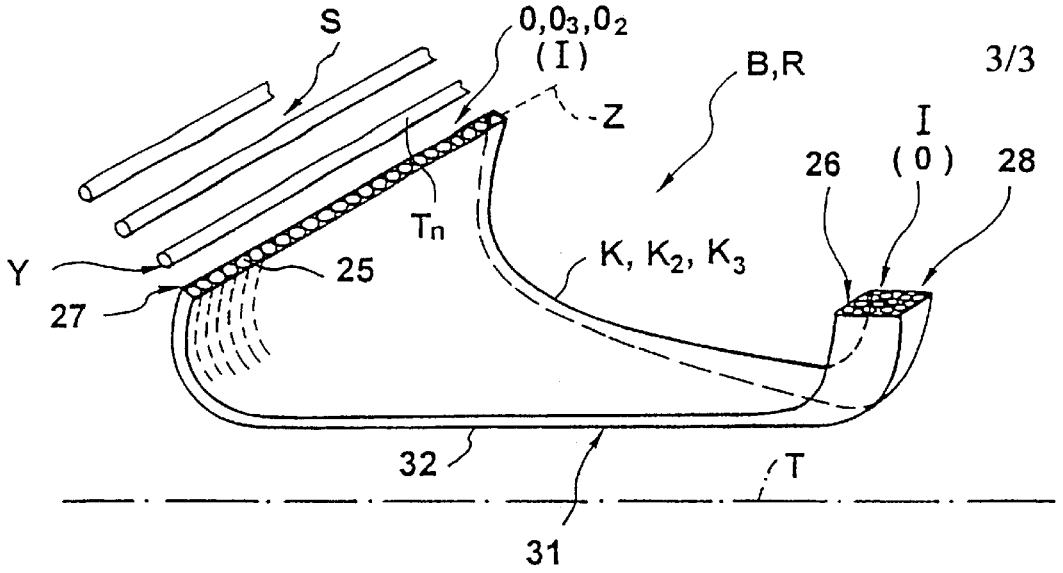
FIG. 8 is a perspective view of a further embodiment.
Figure 9:
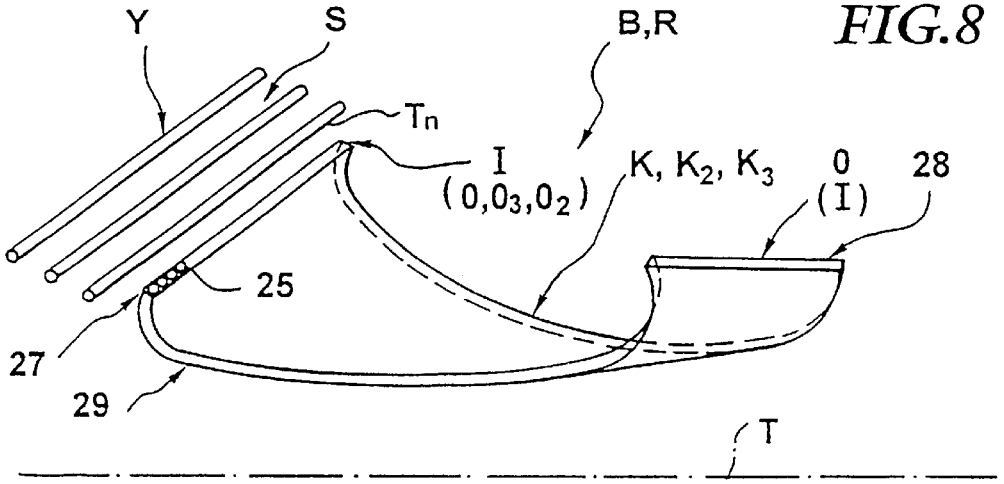
FIG. 9 is a perspective view of a still further embodiment.

The light guides used in the preceding embodiments have substantially point-shaped inlets and outlets 1, 0 with a diameter of about 1.0 mm. Alternatively, as shown in FIGS. 8 and 9 and also in FIG. 10, it is expedient to insert light guides K, K2, K3 for the yarn break sensor B and the reserve or reference sensor R into the storage drum D, with the light guides having an end 27 which is line-shaped and spread in the circumferential direction of the storage drum D to a considerably greater extent than the other end 28 which is axially spaced therefrom and substantially smaller in the circumferential direction of the storage drum. The line-shaped end 27 is oriented approximately in the circumferential direction, i.e., in parallel with windings Tn in the reserve S of yarn Y and is swept over by each winding in a direction transverse to the longitudinal direction thereof. The width of end 27 need only be about 1 mm or less, whilst the length measured in the circumferential direction in the direction of a main axis Z can be 10 mm or more. This end 27 can be used either as the inlet I towards which the light source arrangement is directed with its light outlet, or as outlet 0, 03, 02, so that in such a case the other end 28 is used as inlet I (the joint inlet for all sensors) and is in alignment with the light source arrangement. The light guide according to FIG. 8 may be composed of a plurality of parallel light-guiding fibers 25 which are bundled at end 28 and occupy a square or round, relatively small area on the surface of storage drum T. The axis of storage drum T is outlined in dash-dotted fashion in FIG. 8. The two ends 27, 28 are connected to each other via a light transmitting body 32 (consisting either of light-guiding fibers 25 also defining ends 27, 28, or of a homogeneous light-guiding material). However, it is also possible to design the light guide K, K2, K3 for the yarn break or the reference or reserve sensor R, B as a molding made from plexiglass, optionally as a flexible sheet, i.e., from a material which has light-guiding characteristics (total reflection, light-collecting plastics). The use of such a light guide for the yarn break sensor B or the reserve or reference sensor R will lead to the avantage of a strong modulation as soon as the yarn sweeps over the end 27 in a direction transverse to its longitudinal direction, because this end will be fully covered very rapidly and fully exposed again also very rapidly. Thanks to this strong modulation, the resulting signal can very clearly be distinguished from a signal which is produced when the other end 28 is being swept over, and which exhibits a considerably weaker modulation. The sensing region for the yarn is located above the line-shaped, spread end 27.

The light guide as outlined in FIG. 8 can also be used in a withdrawal sensor W according to FIGS. 3 to 7. The line-shaped end 27 is placed in a region of the storage drum circumference in which the withdrawn yarn has already left the reserve S and has already assumed a substantially axial orientation relative to the withdrawal edge 3. The line-shaped end 27 is then oriented approximately in parallel with the orientation of the yarn in the sensing region to ensure the strong modulation. The other end 28, which possibly serves as inlet 1, is then axially spaced apart from the end 27, for instance, it is positioned closer to the reserve S.

In FIG. 9, the light guide K, K2, K3 for the yarn break sensor B and the reference or reserve sensor R, respectively, is a warped, optionally flexible film band 29 which has a line-shaped end 27 and also a line-shaped other end 28. The line-shaped end 27 is oriented in the circumferential direction of the storage drum T represented by its dash-dotted axis, while the other end 28 is oriented in the axial direction of the storage drum. Each end 27 or 28 can selectively be used as an inlet or an outlet. The film band 29 consists, optionally, of a plurality of fibers 25 which are arranged in parallel. The ends 27, 28 are spaced apart in the axial direction of the storage drum. When during its axial movement the yarn disposed in the circumferential direction moves past the end 27 which is in parallel therewith, a strong modulation will be observed. By constrast, when the yarn moves past the other end 28 at a later time, this movement will lead to a considerably weaker modulation when the yarn is positioned in the circumferential direction or is oriented in a direction oblique to the axis, so that the correct signal can easily be derived because of differently strong modulations.

Figure 10:
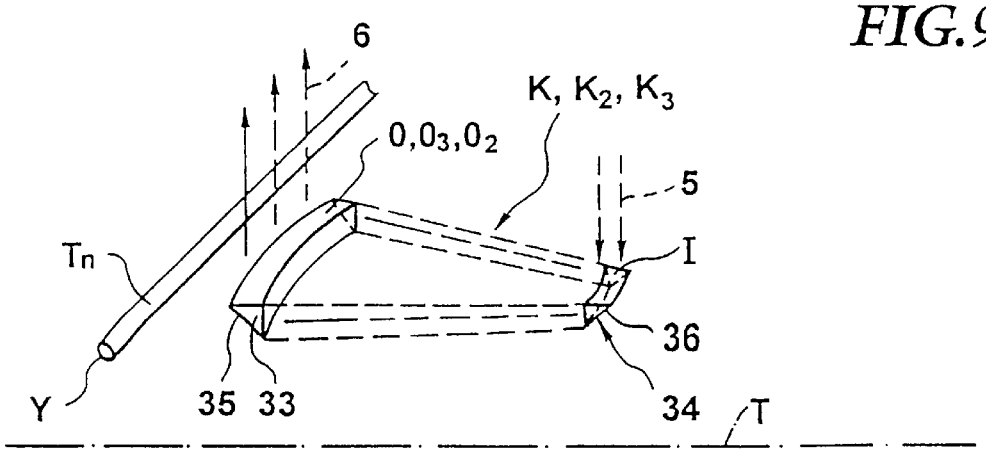
FIG. 10 shows a another embodiment with a prism or mirror arrangement.

As outlined in FIG. 10, the light guide is a prism or mirror arrangement which includes a circumferentially long prism body 33 having a metal coating on its inclined side 35, and a short prism body 34 which is axially spaced therefrom and has an inclined surface 36 which is also metal-coated. The inlet I is, for instance, located at the upper side of the prism body 34. Entering light is reflected in axial direction towards the prism body 33 and is diverted in said body and directed outwards onto the receiver arrangement. The yarn winding Tn expediently moves past the outlet 0 in parallel with its longitudinal axis, which results in a strong modulation. Both prism bodies 33, 34 should be integrated into a light transmitting body, which may e.g. consist of LISA plastics (plastics having light-collecting characteristics and an inner total reflection).

The end 27 of the light guide can rotatably be arranged in the surface of the storage drum, i.e. in a rotatable insert. Hence, the end 27 could selectively be rotated into a position in parallel with the yarn windings sweeping thereover. This means, in the case of the yarn break or reference sensor B, R, approximately in the circumferential direction of the storage drum T; in the case of the yarn withdrawal sensor R, in the axial direction or in an oblique direction, for instance, below 45° relative to the axial direction. These rotary movements are possible thanks to the flexibility of the light guide.

I claim:

1. A feeding device for a yarn, comprising a storage drum having a rear end and a front end, said storage drum having a periphery onto which said yarn can be wound tangentially by means of a winding drive in a plurality of windings which defines a yarn reserve, said yarn being removable in an axial direction from said yarn reserve by axial withdrawal from said front end of said storage drum, and further comprising at least one optoelectronic yarn sensing device arranged stationarily outside said storage drum to sense a sensing region of said periphery, said sensing device including a light source arrangement having a light source outlet oriented towards said periphery, a signal-generating receiver arrangement oriented towards said sensing region and at least one light guide located in said storage drum and having an outwardly directed inlet and an outwardly directed outlet spaced apart from one another, said inlet of said light guide being oriented towards the light source outlet of said light source arrangement and said outlet of said light guide being oriented towards said receiver arrangement, said inlet and said outlet of said light guide being arranged in positions which are at least axially spaced-apart relative to said periphery of said storage drum.

2. The feeding device according to claim 1, wherein said inlet of said light guide is arranged in the axial yarn withdrawal direction downstream of a position of a boundary for said yarn reserve.

3. The feeding device according to claim 1, wherein said inlet and said outlet of said light guide additionally are spaced apart from each other in a circumferential direction of said periphery of said storage drum.

4. The feeding device according to claim 1, wherein said yarn windings include a foremost yarn winding which extends generally circumferentially and defines an axial boundary of said yarn reserve, said outlet of said light guide being disposed in an axial position at said periphery of said storage drum at which the foremost yarn winding is disposed.

5. The feeding device according to claim 1, wherein the outlet of the light guide is arranged adjacent to said rear end of said storage drum in an axial position at which at least first winding(s) of said reserve is or are wound on the storage drum.

6. The feeding device according to claim 1, wherein one end of said light guide is swept over by said yarn windings which extend approximately in the circumferential direction of said periphery, said one end being approximately line-shaped in the circumferential direction of said storage drum and being spread to a substantially greater degree than the other end of said light guide, said one end being axially spaced apart from said other end and being either the inlet or the outlet of said light guide in said sensing device.

7. The feeding device according to claim 6, wherein said light guide comprises a plurality of parallel fibers which are circumferentially positioned side by side at the one end, said fibers being bundled in a round or square configuration at the other end.

8. The feeding device according to claim 6, wherein said light guide is a flat film band wherein said one end is oriented approximately in the circumferential direction of said periphery of said storage drum and the other end is rotated by about 90° relative to said one end and is oriented in the axial direction of said periphery of said storage drum.

9. The feeding device according to claim 6, wherein said light guide is a molded body having said one end being line-shaped and said other end shaped round or square, the one and the other ends being connected via a light-transmitting body, and said light guide being arranged with a main axis of said line-shaped one end being oriented in the circumferential direction of said periphery of said storage drum.

10. The feeding device according to claim 1, wherein said sensing device is a withdrawal sensor for detecting a withdrawal movement or for counting the windings withdrawn from said yarn reserve, and wherein the outlet of said light guide is arranged at an axial position of said periphery of said storage drum downstream of an axial boundary of said yarn reserve, said yarn moving over said axial position during axial withdrawal with a rapid component of motion in the circumferential direction of said storage drum at a respectively different time than when said yarn passes over the position of said inlet.

11. The feeding device according to claim 1, wherein said sensing device has more than one said sensing device, each said sensing device being of a type selected from the group consisting of: a reserve or reference sensor, a withdrawal sensor and a yarn break sensor, a separate light guide being provided for each said sensing device the inlets of said light guides being jointly arranged to define a point inlet at a position of said storage drum which is located outside of the axial extension or beyond an axial boundary of said yarn reserve, a joint light source arrangement being provided for said sensors and being oriented towards said joint inlet.

12. The feeding device according to claim 1, wherein said storage drum is a rod cage with axial rods being arranged side by side in a circumferential direction to define said periphery of said storage drum, said inlet and said outlet of said light guide or of each light guide being arranged in one and the same stationary rod.

13. The feeding device according to claim 1, wherein said light guide is a flexible light guide cable made from glass or plexiglass in a monoblock or multi-core configuration.

14. The feeding device according to claim 1, wherein said light guide is a prism or mirror arrangement.

15. The feeding device according to claim 1, wherein said light source or/and said receiver arrangement comprises more than one said light source or more than one said receiver which are arranged in a direct mutual vicinity or in an overlapping fashion with one another.

16. The feeding device according to claim 1, wherein said light guide is fixed in said storage drum such that the light entering or light exiting directions of said inlet or said outlet of said light guide form an angle with a radius passing through said inlet or outlet and through the axis of said storage drum wherein said angle is defined in a common plane containing the axis of said storage drum.

17. The feeding device according to claim 1, wherein said light source arrangement and said receiver arrangement are combined on a joint circuit board in a slender sensor housing which is arranged at a bottom side of an extension arm of said feeding device, said extension arm extending at a distance along said storage drum.

18. The feeding device according to claim 1, wherein said light source arrangement provides at least temporarily modulated light in a range of 200 kHz.

19. The feeding device according to claim 10, wherein said withdrawal sensor includes a plurality of light guides leading from a joint inlet to a plurality of outlets which are axially spaced from said inlet and are arranged such that they are distributed in the circumferential direction of said storage drum, an exterior receiver arrangement being oriented towards each said outlet, and said withdrawal sensor adapted to be connected to a switch-off control device of a weaving machine which is fed with yarn by said feeding device.

20. A feeding device for a yarn, comprising a storage drum having a rear end and a front end, said storage drum having an outer periphery onto which said yarn can be wound tangentially by a winding drive in a plurality of windings which defines a yarn reserve, said yarn being removable in an axial direction from said yarn reserve by axial withdrawal from said front end of said storage drum, and further comprising at least one optoelectronic yarn sensing device arranged stationarily outside said storage drum to sense a sensing region of said outer periphery, said sensing device including a light source arrangement having a light source outlet oriented towards said outer periphery, a signal-generating receiver arrangement oriented towards said sensing region and at least one light guide located in said storage drum and having an outwardly directed inlet and an outwardly directed outlet spaced apart from one another, said inlet of said light guide being oriented towards the light source outlet of said light source arrangement and said outlet of said light guide being oriented towards said receiver arrangement, said inlet and said outlet of said light guide being arranged in positions along said outer periphery which are at least axially spaced-apart relative to said outer periphery such that light received from said light source passes axially through said light guide from said inlet to said outlet.

21. The feeding device according to claim 20, wherein said light source and said receiver arrangement are at least axially spaced-apart relative to each other.

* * * * *

UNITED STATES PATENT AND TRADEMARK OFFICE
CERTIFICATE OF CORRECTION

PATENT NO : 5 983 955
DATED : November 16, 1999
INVENTOR(S) : Jerker HELLSTROEM

It is certified that error appears in the above-identified patent and that said Letters Patent are hereby corrected as shown below:

Column 10, line 65; after "device" insert ---,---.

Column 10, line 66; change "point" to ---joint---.

Signed and Sealed this

Tenth Day of April, 2001

*Attest:*

Nicholas P. Godici

NICHOLAS P. GODICI

*Attesting Officer*

*Acting Director of the United States Patent and Trademark Office*